US009076181B2

(12) United States Patent
Bhogal et al.

(10) Patent No.: US 9,076,181 B2
(45) Date of Patent: Jul. 7, 2015

(54) AUCTION OVERBIDDING VIGILANCE TOOL

(75) Inventors: Kulvir Singh Bhogal, Austin, TX (US); Rick Allen Hamilton, II, Charlottesville, VA (US); James Robert Kozloski, Yorktown Heights, NY (US); Clifford Alan Pickover, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 687 days.

(21) Appl. No.: 13/296,462

(22) Filed: Nov. 15, 2011

(65) Prior Publication Data

US 2013/0073411 A1 Mar. 21, 2013

Related U.S. Application Data

(63) Continuation-in-part of application No. 13/238,367, filed on Sep. 21, 2011.

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC ..... G06Q 30/08; G06Q 30/0601; G06Q 30/0275; G06Q 30/0641
USPC ..... 705/26.1, 27.1, 26.3
See application file for complete search history.

(56) References Cited

U.S. PATENT DOCUMENTS

| | | | | |
|---|---|---|---|---|
| 6,507,818 | B1 * | 1/2003 | Fishman et al. | 704/270 |
| 7,444,299 | B2 | 10/2008 | Smith et al. | |
| 8,342,928 | B1 | 1/2013 | Teller et al. | |
| 2002/0042769 | A1 | 4/2002 | Gujral et al. | |
| 2003/0033236 | A1 | 2/2003 | Davenport et al. | |
| 2003/0172022 | A1 | 9/2003 | Coyne et al. | |
| 2003/0236734 | A1 | 12/2003 | Guler et al. | |
| 2005/0091140 | A1 * | 4/2005 | Sloan et al. | 705/37 |
| 2005/0125330 | A1 * | 6/2005 | Dinwoodie | 705/37 |
| 2006/0136325 | A1 | 6/2006 | Barry et al. | |
| 2006/0224497 | A1 * | 10/2006 | Walker et al. | 705/37 |

(Continued)

OTHER PUBLICATIONS

Lackes; "Determining factors of online auction prices analysis with data mining algorithms on the basis of decision trees"; retrieved on Aug. 18, 2011 from http://ieeexplore.ieee.org/xpl/freeabs_all.jsp?reload=true&arnumber=56.

(Continued)

*Primary Examiner* — Courtney Stopp
(74) *Attorney, Agent, or Firm* — Robert H. Frantz; Damion Josephs

(57) ABSTRACT

Vigilance monitoring and a navigation aid are provided to a user in an electronic auction by receiving by a computer a command to watch similar items to a first item in an online or electronic auction; extracting by a computer from the command, from the auction, or from both the command and the auction one or more item descriptive parameters; using by a computer the extracted parameters to query one or more online or electronic sales sources for similar items matching the extracted parameters, the sales sources being electronic sources other than the auction; receiving by a computer at least one price for an available similar item from at least one sales source; and causing prompting by a computer a user of the auction with the similar item price and sales source.

18 Claims, 9 Drawing Sheets

(56) References Cited

U.S. PATENT DOCUMENTS

| | | | | |
|---|---|---|---|---|
| 2007/0130090 | A1 | 6/2007 | Staib et al. | |
| 2007/0143171 | A1 | 6/2007 | Boyd et al. | |
| 2009/0157522 | A1 | 6/2009 | Srinivasan et al. | |
| 2010/0076860 | A1 | 3/2010 | Kaghashvili | |
| 2011/0173086 | A1 | 7/2011 | Berkowitz | |
| 2012/0123674 | A1 * | 5/2012 | Perks et al. | 701/426 |

OTHER PUBLICATIONS

Schamel; "eBay-eConomics:Factors that Determine Online Auction Prices" retrieved on Aug. 18, 2011 from http://ageconsearch.umn.edu/bitstream/20407/1/sp04sc06.pdf.

Wikipedia; "High-Frequency traing"; retrieved on Aug. 21, 2011 from http://en.wikipedia.org/wiki/High-frequency_trading.

Wikipedia; "Market microstructure" retrieved on Aug. 21, 2011 from http://en.wikipedia.org/wiki/Market_microstructure.

USPTO; Examination Correspondence from a Related U.S. Appl. No. 13/238,367, filed Sep. 21, 2011 by Kulvir S. Bhogal (Office Action 1).

USPTO; Applicant's reply on Aug. 6, 2014 to first Office Action from related U.S. Appl. No. 13/238,367, filed Sep. 21, 2011 by Kulvir S. Bhogal.

USPTO; first Office Action mailed on May 4, 2015 in related U.S. Appl. No. 13/473,871, filed on May 15, 2012.

USPTO; Examination Correspondence from a Related U.S. Appl. No. 13/238,367, filed on Sep. 21, 2011 by Kulvir S. Bhogal,.

USPTO; Applicant's reply to the Examiner filed on Apr. 14, 2015 a Related U.S. Appl. No. 13/238,367, filed on Sep. 21, 2011 by Kulvir S. Bhogal,.

USPTO; Examiners Action mailed on May 18, 2015 in a Related U.S. Appl. No. 13/238,367, filed on Sep. 21, 2011 by Kulvir S. Bhogal.

* cited by examiner

AUCTION OVERBIDDING VIGILANCE TOOL

This is a continuation-in-part of U.S. patent application Ser. No. 13/238,367, filed on Sep. 21, 2011, by Kulvir S. Bhogal, et al. The invention generally relates to tools and utilities for assisting users of an online or electronic auction system to maintain a real-time vigilance against potential overbidding.

FIELD OF THE INVENTION

Background of Invention

FIG. 6 shows a generalization of the well-known arrangement (600) of components for an electronic or online auction. Generally, one or more computer networks (601) interconnect at least one offeror's console with typically a plurality of bidder's consoles, and one or more auction server computers (602). The offeror's console may be a variety of computer devices, such as a personal computer (desktop, laptop, notebook, etc.), a tablet computer, or a smart cellular telephone phone (e.g. Apple iPhone™, Google Android™ phone, Research in Motion Blackberry™, etc.). The bidder's console(s) may take the same various forms as the offeror's console. The auction server may also be of one of these forms of computer devices, and alternatively it may be a more powerful "server" class of machine, such as an enterprise server, blade server, etc., running a much more capable operating system, such as IBM's AIX™, or a variant of UNIX™. Additionally, the auction server may be a conglomeration of hardware and software assets dynamically tasked to achieve the logical results of an auction server, such as an on-demand computing environment, a "cloud" computing environment, and a grid computing environment. The interconnecting computer networks may include one or more suitable data and voice communications networks, such as the Internet, an intranet, a virtual private network, a wireless network, a local area network, a wide area network, a telephone network, a radio link, and an optical link.

To place an item "up for auction", a bidder console is used to create and upload certain digital assets regarding the offered item, as well as one or more offering parameters, to the auction server. The digital assets might include one or more digital photographs, one or more video clips, and one or more textual descriptions of the item. The offering parameters may include identification information regarding the offering party (e.g. name, address, email address, web site address, telephone number, ratings or rankings for previously auctioned items, etc.), as well as parameters regarding the price (and optionally quantity) of the item(s) being offered (e.g. minimum bid, maximum bid a.k.a. "buy it now" price, auction opening time and date, and auction closing time and date).

The auction server receives and stores the digital assets for the item in a database (608), for later retrieval and transmission to the bidder consoles during the auction. The auction server receives and stores the offering parameters and implements those in a profile for the auction associated with the offeror's account.

After the auction opening time and date, and prior to the auction's closing time and date, the auction server then interacts with the bidder's consoles to provide the digital assets for the item being offered, as well as to provide any bid status information (e.g. minimum bid, maximum bid, current bid, time left to close, etc.) to a bidding party. The auction server receives from the bidder console(s) one or more bids containing bid parameters (e.g. bid or offer-to-buy value, optionally with quantity indicator). The auction server then processes each received bid according to one or more auction schema (e.g. straight auction, Dutch auction, reverse auction, etc.), and updates the bid status and auction status for the item being offered. For example, if a bid is below the minimum bid offering parameter, the bid may be rejected. If a bid is above the minimum bid offering parameter and bests the current bid level, the bid may be accepted and the current bid level updated to reflect the best bid. If the bid meets or exceeds the maximum bid, the auction may be closed and the item may be marked as sold. When the auction closing time and date arrives, the auction may be closed and the current bid declared the "winner". And, if a bid is received after the auction closing time and date, the bid may be rejected.

Ultimately, the auction is concluded with or without the item being sold. If no bids above the minimum bid offering parameter are received, then the auction may close without a winner or purchaser. If the auction is concluded during active bidding upon the expiration of the auction "window", then the best bid is selected, where "best" may be the highest monetary value bid, or may be a combination of monetary bid value and quantity bid (in the situation of multiple items being available). For example, an airline offering seats on a particular flight route may accept a lower "dollar per seat" bid value if the bidder is offering to purchase a superior quantity of seats.

Upon the conclusion of the auction, with or without a successful sale being consummated, the auction server may archive certain information, such as the digital assets for the offered item, the bid parameters (winning bid value and quantity), and auction results (identification of winning party(ies), etc.) into a historical sales database (609). This information is then used to facilitate billing of the bidding party, reimbursement of the offering party, and other administrative functions (auditing, accounting, marketing, etc.).

SUMMARY OF THE INVENTION

Vigilance monitoring and a navigation aid are provided to a user in an electronic auction by receiving by a computer a command to watch similar items to a first item in an online or electronic auction; extracting by a computer from the command, from the auction, or from both the command and the auction one or more item descriptive parameters; using by a computer the extracted parameters to query one or more online or electronic sales sources for similar items matching the extracted parameters, the sales sources being electronic sources other than the auction; receiving by a computer at least one price for an available similar item from at least one sales source; and causing prompting by a computer a user of the auction with the similar item price and sales source.

BRIEF DESCRIPTION OF THE DRAWINGS

The description set forth herein is illustrated by the several drawings.

DETAILED DESCRIPTION OF EMBODIMENT(S) OF THE INVENTION

The inventors of the present and related inventions have recognized—problems not yet recognized by those skilled in the relevant arts. The inventors have realized that when an offering party, whether they be an individual person or a corporate entity, wishes to offer an item for sale in an online or electronic action, they must first determine a reasonable set of offering parameters such as a minimum bid, the length of time to allow the auction to proceed, whether or not to offer a maximum "buy it now" bid option, and if so, what the maximum bid value should be. Usually, such potential offerors will do some sort of informal and incomplete review of similar items to determine a starting price, or, in the case of extremely valuable items, they may have a professional appraisal performed. However, for less valuable items, such time and expense is not warranted relative to the item's value, so they often take a best guess at these offering parameters.

The inventors have recognized this problem and have addressed it with with the related invention to allow for an automated, thorough and well-grounded prediction of an item's auctionable value and pendency in the auction.

Further, the inventors have realized that during bidding, especially during the final period of bidding, some bidders may find it difficult to maintain an awareness of the actual retail value of the item on which bidding is occurring. Such a period of final bidding is often marked by a quickened pace of bidding (e.g. less time between successive bids), and often by greater increases to beat previous bids in order to attempt to assure to overwhelm counter-bidders. This "bidding frenzy" is known to often move the current bid level over the retail value of the item. If the auction is for a charitable cause, this is often an acceptable practice. But, for most other auction scenarios, this is counterintuitive for bidders to be drawn into a psychological competition, one of whom ends up purchasing the item for more than it could be purchased through a non-auction retail source (or through a non-auction wholesale source in the case of business-to-business auction).

Auction Price Offering Tool of the Related Invention

Figure 6:
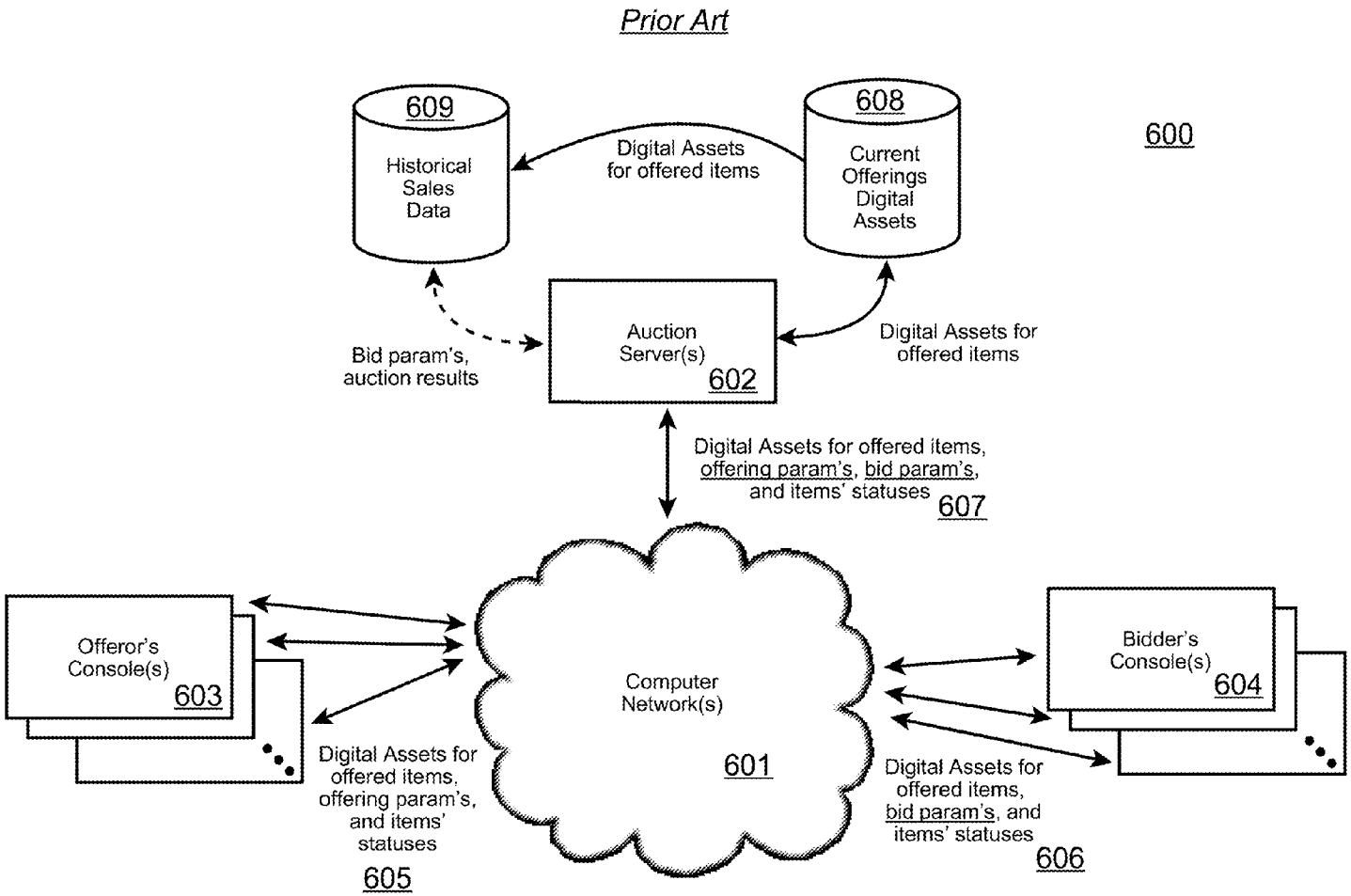
FIG. 6 illustrates a generalization of well-known components of an online or electronic auction system.
Figure 7:
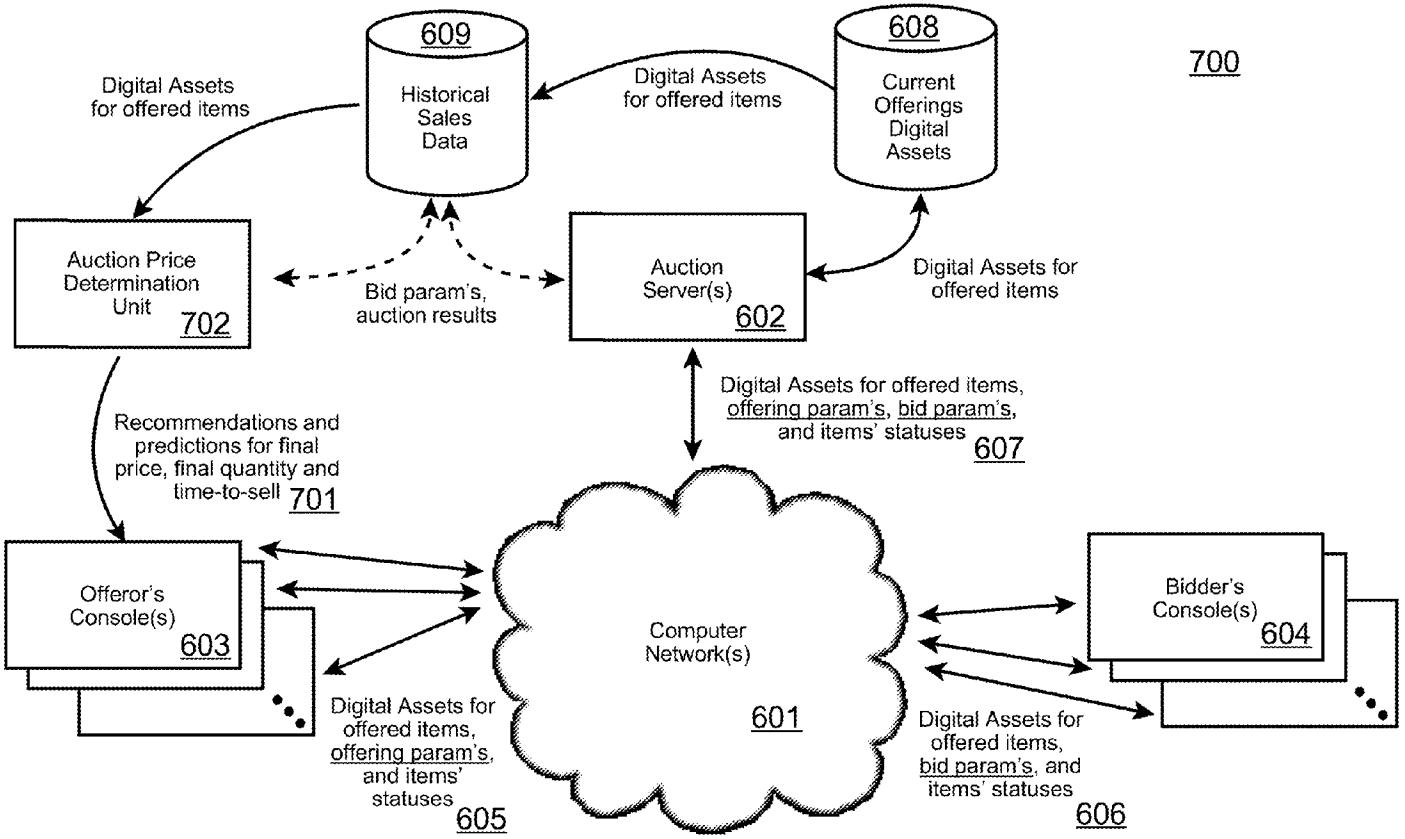
FIG. 7 provides an example embodiment of an improved arrangement of components of an online or electronic auctioning system according to at least one embodiment of the related invention.

Turning to FIG. 7, an enhanced arrangement (700) of components for an online or electronic auction is shown according to at least one embodiment of the related invention, which in addition to the components of FIG. 6, adds an Auction Price Determination Unit (APDU) (702) which is communicably interfaced to the historical auction sales data (609) to receive digital assets (photos, descriptions, etc.) regarding items previously sold and unsold in the auction, bid parameters regarding results of previously concluded auctions (number of bids, length of time in auction until sale completed, pace of bids, values of bids, values of increments in the bids, etc.). The APDU is also communicably interfaced to the offeror's console (603) so as to propose potential offering parameters (minimum bids, maximum bids, length of auction, etc.). The communications interfaces between the APDU and the historical sales data and the offeror consoles can be any of the previously-described networks (601), and may also be through direct integration to the auction server (602), to the offeror console, or through a combination of direct integration with the auction server and offeror console. Such integration may be through providing one or both of the auction server and the offeror console with program code modifications or additions (C, C++, cobol, Java, Java Beans, etc.), extensions, plug-ins, helper applications, dynamic link libraries (DLLs), locatable objects (e.g. CORBA, etc.), and the like, all of which may be provided in tangible form through storing them on tangible, computer readable memory devices, or through loading them into a processor and executing them, or through a combination of storage, loading, and executing.

Figure 8:
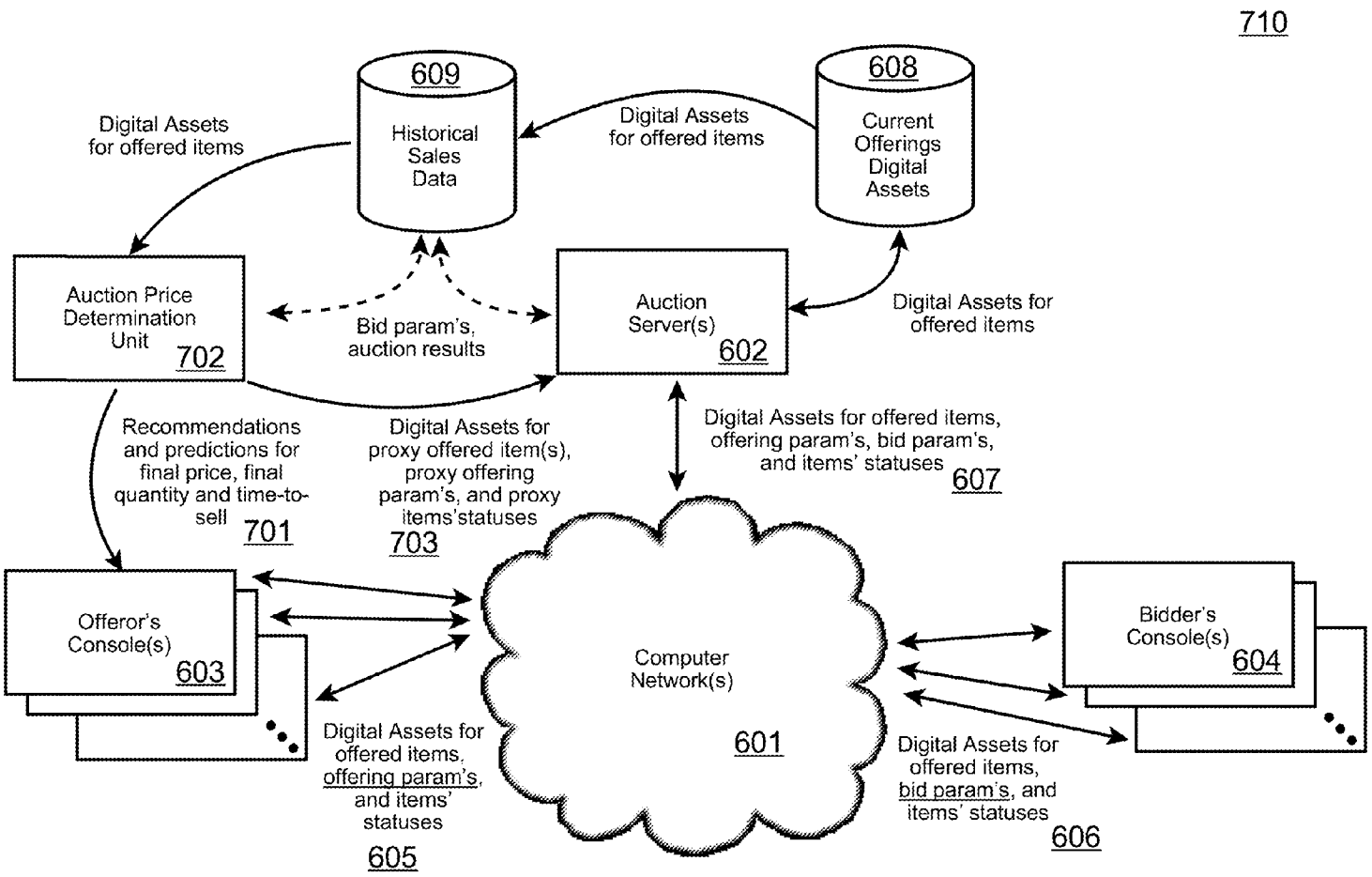
FIG. 8 provides an example embodiment of an improved arrangement of components of an online or electronic auctioning system according to at least one embodiment of the related invention in which proxy items are offered into the auction.

FIG. 8 illustrates another enhanced arrangement (701) of components according to at least one embodiment of the related invention of an online or electronic auction system, similar to those illustrated in FIGS. 6 and 7, with the further enhancement of the APDU (702) providing one or more proxy items (703) into the auction so as to create auction activity relevant to the task at hand as described in the following paragraphs. By "proxy", we are referring to an item having a similar or the same description and optionally the same quantity as the real item which is to be offered in the auction. By offering such a substitute item into the auction and allowing a period of bidding to proceed on it, relevant information can be obtained about the likely bidding values and pattern that will occur with the real item is offered. The use of this technique is further described in more detail in the following paragraphs.

Figure 1A:
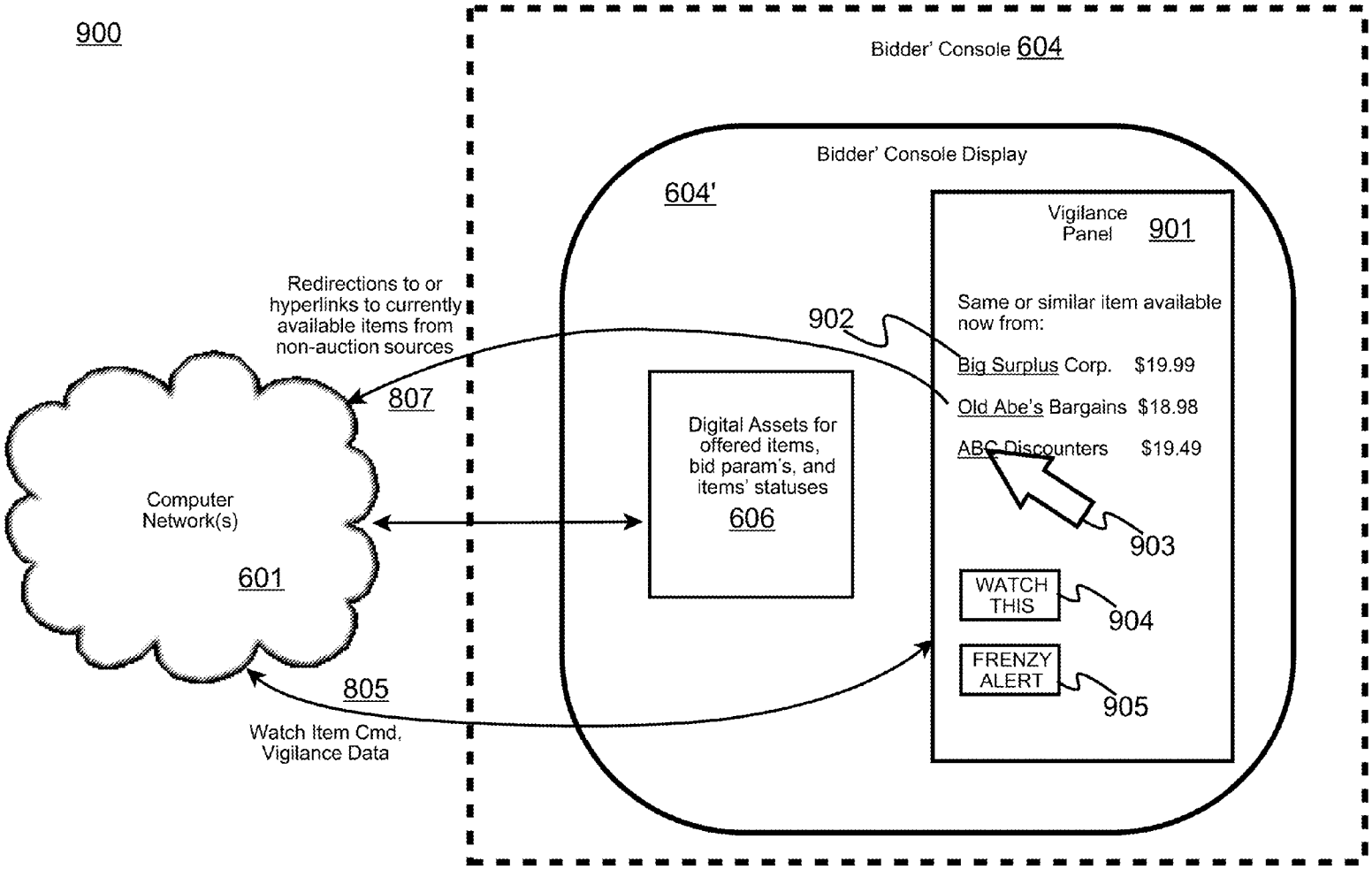
FIG. 1*a* shows an example user interface according to the present invention.
Figure 1B:
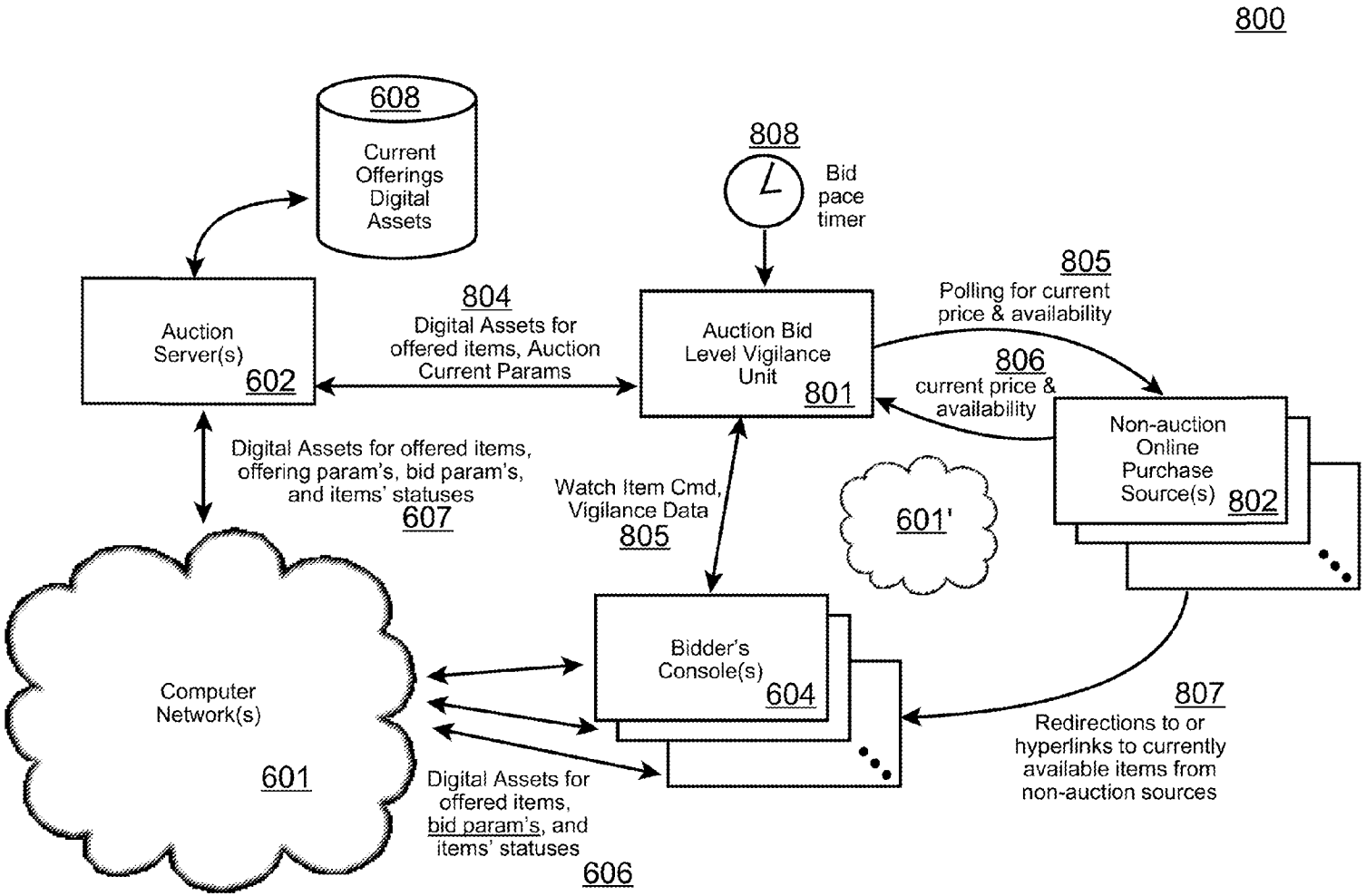
FIG. 1*b* illustrates an example arrangement of components and functional flow according to the present invention.
Figure 2:
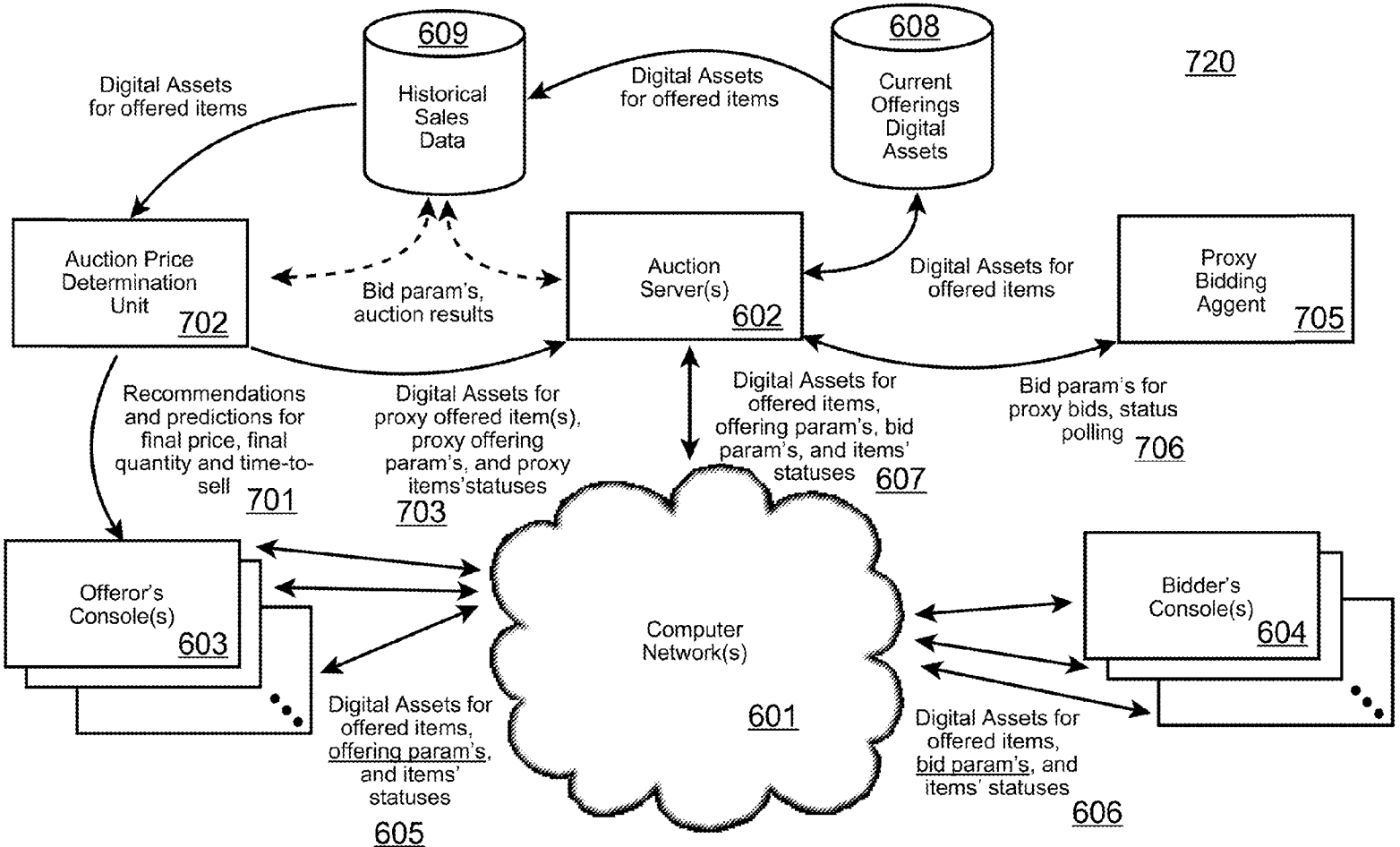
FIG. 2 depicts another example embodiment of an improved arrangement of components of an online or electronic auctioning system according to at least one embodiment of the related invention in which proxy items are offered into the auction, and in which proxy bids are made on the proxy items.

FIG. 2 also depicts an enhanced arrangement (720) according to at least one embodiment of the present invention, which, like the arrangement of FIG. 1, provides proxy items (703) in the auction server (602), but also provide a proxy bidding agent (705) which enters proxy bids (706) into the auction, details of the process for which will be described in subsequent paragraphs.

Figure 3:
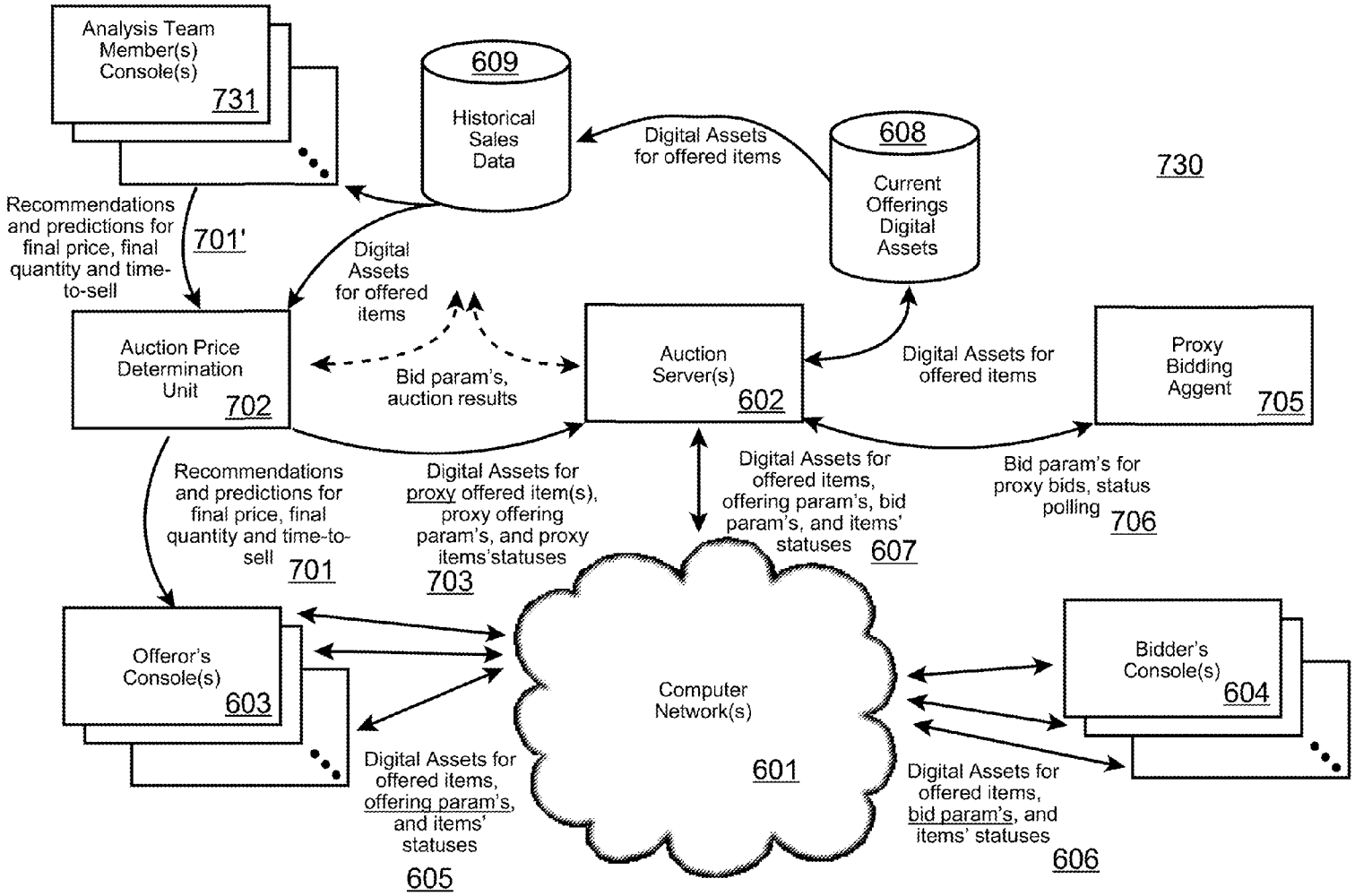
FIG. 3 illustrates a further embodiment according to the related invention in which market analysis services are integrated into the arrangement of components.

Turning to FIG. 3, a further enhanced embodiment and arrangement (730) of components according to the related invention is shown in which one or more analysis team member console(s) (731) are communicably interfaced to the APDU (702), and optionally to the historical sales database (609), so as to allow expert analysts to be consulted under certain conditions, and to allow the expert analysts to provide via the consoles (731) recommendations for the minimum bid, maximum bid and auction time window offeror parameters (701').

Logical Process Examples. The following paragraphs set forth example logical processes according to the related invention, which, when coupled with processing hardware, embody systems according to the related invention, and which, when coupled with tangible, computer readable memory devices, embody computer program products according to the related invention.

Embodiments of the related invention help an auction offering party (e.g. a user) to determine a relevant price for an item that he or she may wish to offer or sell an item in an electronic or online auction. Embodiments of the related invention perform an initial analysis by scanning histories of sales of similar, related, complementary, or competitive items, or combination of two or more of these types of items, then automatically triggers additional market analysis services when a price suggestion has a high uncertainty level, i.e. when the certainty level of the suggested price is below a threshold value. In this manner, the offeror is more likely to obtain accurate pricing information.

Moreover, embodiments of the related invention may be realized as an enhancement to available online and electronic auction systems, which may include auction systems that provide users with suggested prices. Specifically, this related invention describes a means of enhancing such responses with automated queries to third party market analysis services, such as a team of analysts, under various conditions. The system also suggests optimal times to sell an item as well, as well as a plurality of probabilities of sale for a set of different possible offering prices (e.g. 90% for $5000 but 40% for $8000). The automatic market analysis service may include initiation of an automatic, computer controlled auction in which a similar "proxy" item (or items) is offered for an abbreviated time.

As previously mentioned, users of auction systems are often uncertain as to a reasonable price to ask for items to be auctioned or sold. For example, if a offeror has a three-year-old computer hard drive to offer into an auction, should he attempt to obtain $20, $100, or $200 for the unit? Further, how long should he allow the auction window to be open? The answer to these questions will determine his set price if sold under traditional circumstances, or a minimum price if auctioned. Currently, this determination is typically done by the auction seller manually analyzing sales and posing as a buyer. This, of course, requires time invested on behalf of the seller, and, in some cases, may discourage would-be sellers from participating in auctions.

Additionally, users may wish to receive suggested prices with probabilities of sale for different periods of time. For example, a price of $20 may be associated with a 90% chance of sale during holiday times, while a price of $100 may be associated with a 50% chance on weekends, but a 60% chance on weekdays, based on empirical evidence.

Such estimates may be obtained by analyzing past sales; however, sometimes, there will be insufficient information, and any suggested prices will be "uncertain." Embodiments of the related invention overcome this uncertainty and provide a more certain answer.

Still further, users may want to know what the ideal price is for a 'Buy It now' type auction (e.g. maximum bid value) is that yields the least time to sell. For example, if one sells an item for $1 he will likely sell within 5 days, but if he sells the same item for $1.50, the sale will likely take 10 days. Note that the feature disclosed herein creates a "stickiness" for users of auction systems and services, such as eBay™, as well as non-auction listing services such as Craig's List™. If an auction service provides the functionality described herein, perhaps for a small fee, which may be managed by the service, more users will be likely to use this service (and continue to use this service because the system allows the users to determine reasonable asking prices and requires less research to be performed by a potential seller.

A typical user may have various degrees of knowledge about prices to ask for items for sale, such as antiques, computer equipment, or cleaning services, although such knowledge and needs may be extended upward to expensive items like homes. One way to determine a reasonable asking price is for an auction service to mine past sales, then analyze and aggregate such information for a user. However, in some situations, the analyzing element may not have sufficient past data, and a means is needed to improve the suggested price delivered to a person who wishes to sell or auction an item.

So, embodiments of the related invention provide functionality for enhancing online auctions and listing services to provide for determining recommended prices by automatically triggering additional automatic market analysis services when a price suggestion has a high uncertainty level, i.e., when the certainty of the suggested price is below a threshold. For example, a user submits an item description for an item to sell. Alternatively, the user may be selling a service instead of a good, such as a house cleaning service.

The APDU (Auction Price Determination Unit) suggests a price based on a combination of several of the following elements in at least one embodiment:

1) A mining of price information of sales in the past for the same, similar, or complimentary items or services. Note the analysis might take into account condition of the item being sold.
2) A market analysis team component, automatically triggered when the certainty associated with a suggested price is low. This step may involve a signal sent to a marketing team who may charge a fee for such expertise and service.
3) A user profile that specifies information about the user (for example, does the user typically want a fast sale)
4) Automatic initiation of a short-term auction of a similar item, designed to probe auction markets by means similar to those employed by High Frequency Trading in financial markets.

The user profile in element 3 above may be stored on a user's computer, on a cloud, in a mobile device, etc. Such a user profile may contain financial information about a user, a level of risk and risk avoidance, a desire for fast sales, and other related parameters. A confidence (e.g. certainty) value is updated at regular intervals to indicate how sure the system is with respect to a response (a price). For example, after scanning databases of past sales, the system may request price estimates from more than one (human) market analysis team. Once such information is gained from teams, confidence values will likely increase. Note that such teams may charge small fees for such services. In practical operations, users may not seek many teams for low-price items but may be willing to use this system to probe one or more teams if the potential value of the item for sale is high.

Also, some teams may respond faster than others, and, in the interest of time, a user may specify desired timing. In one embodiment, multiple third party services may be employed to provide the aforementioned suggestion data. The third parties might be rated by people auctioning in terms of accuracy of their predictions when compared to the final price, quantities, and times at which actual items sold. Users who are auctioning may end up preferring one suggestion service over another, similar to user preference for Rotten Tomatoes™ versus Internet Movie Database (IMDB)™, for movie ratings. Suggestion services may be ranked according to industry expertise as well. For example, "Suggestion Service A" might prove to be accurate predictors of technology items, whereas they might be less capable in predicting prices for sports memorabilia. "Suggestion Service B" on the other hand may be a better predictor for sports memorabilia as opposed to technology item pricing.

Figure 4:
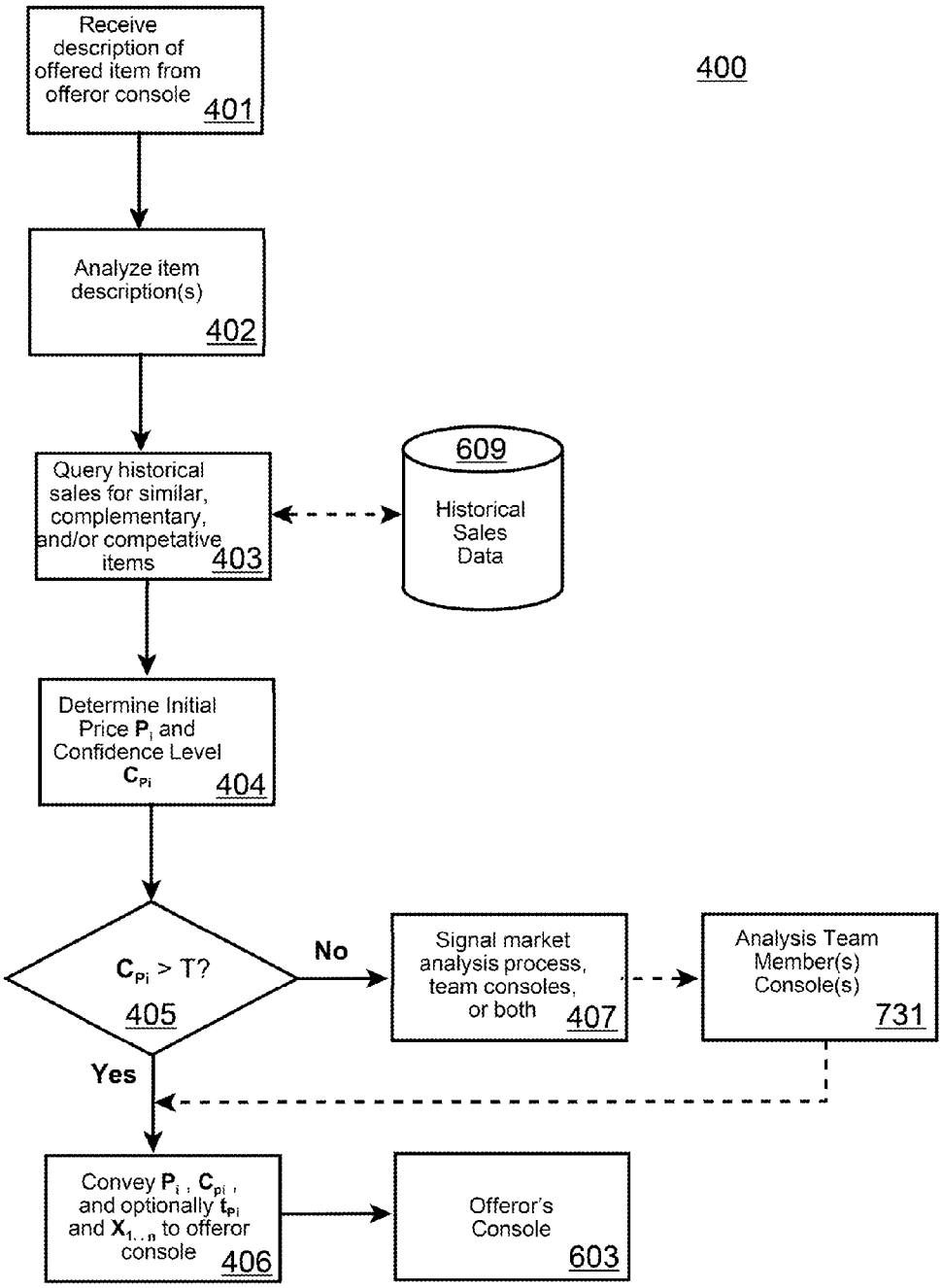
FIG. 4 provides an example logical process according to the related invention.

The preceding paragraphs have described aspects and components of various embodiments of the related invention, from which the present invention is derived. FIG. 4 sets forth a basic logical process (400) according to the related invention which highlights several notable aspects of the inventive method:

1. A user expresses a need to determine a price for an item for sale or auction—and provides a description, which is received (401) by the APDU (702) either directly or via the auction server.
2. The APDU analyzes (402) the item description, queries (403) the historical sales (609), and determines (404) an initial price $P_i$ and confidence level $C_{Pi}$ associated with the initial price $P_i$.
3. If (405) the confidence level $C_{Pi}$ is less than a threshold T, the a signal is triggered to one or more automatic market analysis services, which is at least one novel step of the present embodiments being described.
4. When the confidence level $C_{Pi}$ is greater than (or equal to) the threshold T, the APDU conveys (406) the suggested price to the user. The system optionally suggests optimal time $t_{Pi}$ to sell the item (e.g. months, holidays, etc.) at the suggested initial price. The system also optionally suggests one or more probabilities $X_{1 \ldots n}$ of sale for different possible prices (e.g. 90% probability of sale at a price of $5000, but only 40% probability of sale at a price of $8000, etc.)

Embodiments of the related invention may also optionally perform a multi-objective optimization over time and price and present the results as a two dimensional probability distribution.

The analysis (402), querying (403) and determining (404) may be performed using a machine learning mechanism to calculate the confidence level $C_{Pi}$. The system may compute a ranked list of prices $P_{1 \ldots n}$, each with a confidence value $C_{1 \ldots n}$. An Unstructured Information Management Architecture (UIMA) may be used to facilitate the Natural Language Processing (NLP). Also, in these steps, a user-specified confidence level may be employed or considered.

In the signaling to expert analysis team(s) (704), the APDU may, in some embodiments, identify eligible market analysis services, relevant to the user's item for sale. It may rank the market analysis services in order of their likely utility in determining suggested prices for items for sale or auction, and in their likely ability for increasing the confidence level. The ranking may be determined by analyzing the quality of past contributions from market analysis services and various ratings.

The system conveyed information to the offeror's console may include a probability of sale for an item for a set of different possible prices. As an example, consider an item that has a 90% chance of sale if offered for $5000, but only a 40% chance of sale if offered at a price of $8000. This set of probabilities may be determined and provided to the seller in the form of a useful graph, pie chart, or other form. The system may estimate such probabilities [e.g. X(5000)=90% and X(8000)=40%] by, for example, analyzing previous sales or by querying experts (e.g. automatic market analysis services) in such sales. As an example, if an item sold quickly when 5 of 6 auctions offered the item (or similar item) for $5000 yet sold only one item when offered for $8000 during the past year, X(5000) would naturally be greater than X(8000).

Optional Proxy Probing Component. The automatic market analysis service may include initiation of an automatic, computer-controlled short-term auction in which a similar "proxy" item (or items) is offered for an abbreviated time, during which other buyers (and automatic, computer-controlled bidding elements) are able to place bids on the proxy item. The proxy item may not actually be sold during the abbreviated auction, or may be sold to an automatic bidding element and held in reserve by a third party, without demand for delivery, to be exchanged for a similar reserve items at some future date (i.e., a "market-clearing"). If in the process of performing this abbreviated auction, the item (or items) is sold to a buyer who actually demands delivery, the user of the service may be required by contract to deliver the original item(s) at the agreed price of the proxy item. In this way, a market may be "probed" and its microstructure analyzed, potentially at a small cost or fee to the offeror, to determine the appropriate sale price of the original item. The auction and transaction costs may be then passed on to the user of the system as a fee for the service. Note that an auction service may find these various transactions to be acceptable because it receives listing fees.

Further, the element that sends a signal to a market analysis service may implement a strategy for setting the price for solicited information about an auctionable item, as well as setting a start time and deadline for soliciting and receiving information, respectively, from ranked experts. After the deadline is reached, the price may be adjusted and the deadline extended, or the offer could be withdrawn. These decisions could be based on the information collected during the market analysis service queries, or through other efforts. They could also be based on the desired confidence level and the price the user is willing to pay for a given confidence level (see elaboration of Step 4, below.) The effect of implementing this strategy is that it could improve the efficiency (i.e., cost and speed to reach certain confidence level) with which information is collected from ranked market analysis services, i.e., the experts about particular items or classes of items for sale.

Real-time Bid Level Vigilance Tool

The tool of the related invention, described in the foregoing paragraphs, is designed primarily to assist an offeror in determining minimum opening bids, maximum bids (e.g. "buy it now" value), and auction window times.

In a related effort to provide one or more analogous assistive tools to bidders, but potentially to offerors as well, the present invention addresses the tendency to overbid an item's value above that for which it could be purchased through a non-auction source, such as a retail website or a wholesale website.

FIG. 1*b* shows an example arrangement (800) of components according to at least one embodiment of the present invention in which a computer, such as a server computer, is disposed to monitor the auction status as well as to monitor one or more non-auction websites. In this arrangement, an Auction Bid Level Vigilance Unit (ABLVU) (801) is communicably disposed, preferably through one or more computer networks (601'), to receive a Watch Item Command (805) from a bidder's console (604). This command would include, typically, a link to an auction being offered by the auction server (602), such as an auction number, item number, or even a set of item descriptive parameters regarding the item (e.g manufacturer and model number, color, size, quantity, weight, etc.).

Using information associated with the watch item command, the ABLVU may poll or monitor the auction status from the auction server (602), retrieving auction current parameters such as a current bid level, the time to close of the auction, and, if available, a maximum bid value (a.k.a. "buy it now" value). If the watch item command did not include item descriptive parameters (e.g manufacturer and model number, color, size, quantity, weight, etc.), then some or all of these may be retrieved from the auction's description of the item, as well.

The ABLVU then may use the item descriptive parameters to poll (805) one or more electronic non-auction sources (802), and optionally one or more additional auction servers (not shown), for real-time retail or wholesale values of the item(s). Current price and availability from these sources (802) are returned to the ABLVU, which may be returned to the bidder's console (604) via vigilance data (805). The vigilance data may include price, availability, and a source identifier, and may optionally further include descriptive items such as pictures, videos, buyer ratings, etc. Additionally, one or more redirection commands or hyperlinks (807) may be provided to the bidder console to assist in displaying the vigilance panel, and to assist the user in navigating to the desired source (described in the following paragraphs).

Throughout the auction window, the ABLVU monitors the current bidding level and the non-auction source prices and availabilities. If the current bidding value is approaching, has reached or exceeded the price of an available item from a non-auction source, or from another auction source, the vigilance panel will alert the user and allow the user to navigate directly to the alternative source for the item. Optionally, a bid pace timer (808) may be employed by the ABLVU to detect when bidding pace has increased above a threshold or by a percentage greater than the average bidding pace for the auction, which may indicate a bidding frenzy has started. If so, the vigilance panel may also provide an alert or warning to the user of this condition.

Turning to FIG. 1*a*, an example user interface shown on a portion of a display (604') of a bidder console (604) is provided with a Vigilance Panel (901) in addition to or association with the normal display of auction item information (606). This panel (901) allows the user to click or select (903) a "watch this" button which generates a Watch Item Command (805) to the ABLVU. Vigilance Data (805) produced by the ABLVU is received, and current sources (902) are shown with price and quantity as available from each source. Each source in the list (902) may be provided with a hyperlink or redirection mechanism (807) so that the user may select (903) one or more of them and be navigated to a web page where the item might be reviewed, and optionally purchased from the source outside the auction. The panel (901) may also include the aforementioned Frenzy Alert (905), which may take the form of an icon, a sound, a color change, or similar attention-grabbing user interface.

Restraint of Auto-bidding Agents. Some auction systems allow bidders to configure automatic bidding agents to act on their behalf. These machine functions allow a bidder to specify a maximum bid value, and sometimes to specify bid increments and even a bid pace or time value. Then, the bidder is relieved of the task of actually monitoring the auction status and placing counter bids because the bidding agent will automatically post bids to best the top bid, up to the maximum bid level set by the bidding user (and within the time and pace criteria specified by the user, if provided).

However, such an automatic bidding agent may also overbid an item's actual retail value if the bidding user does not know the actual retail value. So, in one enhanced embodiment of the present invention, the automatic bidding agent is augmented to include a restraint signal from the ABLVU. If, at any time, the automatic bidding agent is about to bid over an actual retail value as discovered by the ABLVU, the ABLVU can prevent or disable the automatic bidding agent from placing the bid, and then may notify the bidding user of the potential overbid. As previously described, the bidding user may then be presented with a range of options, including (a) allowing the over-bid to be placed, (b) disabling the automatic bidding agent, and (c) following a link or redirection to a web page or screen on which the item can be purchased directly outside the auction (or in another auction).

Historical Bid Value Suggestion(s). In yet another potential enhanced embodiment according to the present invention, historical sales data of similar items may be analyzed as described with respect to the related invention, but in the case of the present invention, the results of the historical analysis are presented to the bidding user to suggest likely winning bid values and likely losing bid values. For example, a bidder may be looking at an item for auction which has historically sold at around $25 to $30. If the bidder configures an automated bidding agent to not go beyond a top bid of $15, then the historical analyzer portion of the ABLVU may prompt the bidding user to indicate a low likelihood of winning at such a top bid value, and may optionally suggest a value of $22 or $24, just below the historical value.

Local Convenience Offset. In still another enhancement of embodiments of the invention, the bidding user is provided an input option for a local convenience offset value which accounts for a slight premium the user may be willing to pay for an item online in trade for the convenience of not having to obtain the item locally. For example, a user lives in a large metroplex, and is bidding on an item in an auction which is available across town for $25 from a local retailer. Because the commute across town may be time consuming and may require fuel costs, tolls, bus fare, taxi charge, or mass transit fees, the bidding user may be willing to pay a slight premium in the online auction for the convenience of having the item delivered to their residence or business. In this enhancement, then, the ABLVU is configured to allow the user to input a local convenience offset value, which is added to the real-time available local retail value that might be discovered by the ABLVU during the auction. In our example, the user might assign $5 to the local convenience offset, and thus the ABLVU would not enact any controls, restraints, or warnings until the bidding in the auction reached $25 plus $5, or $30 total.

Suitable Computing Platform. Regarding computers for executing the logical processes set forth herein, it will be readily recognized by those skilled in the art that a variety of computers are suitable and will become suitable as memory, processing, and communications capacities of computers and portable devices increases. In such embodiments, the operative invention includes the combination of the programmable computing platform and the programs together. In other embodiments, some or all of the logical processes may be committed to dedicated or specialized electronic circuitry, such as Application Specific Integrated Circuits or programmable logic devices.

Figure 5:
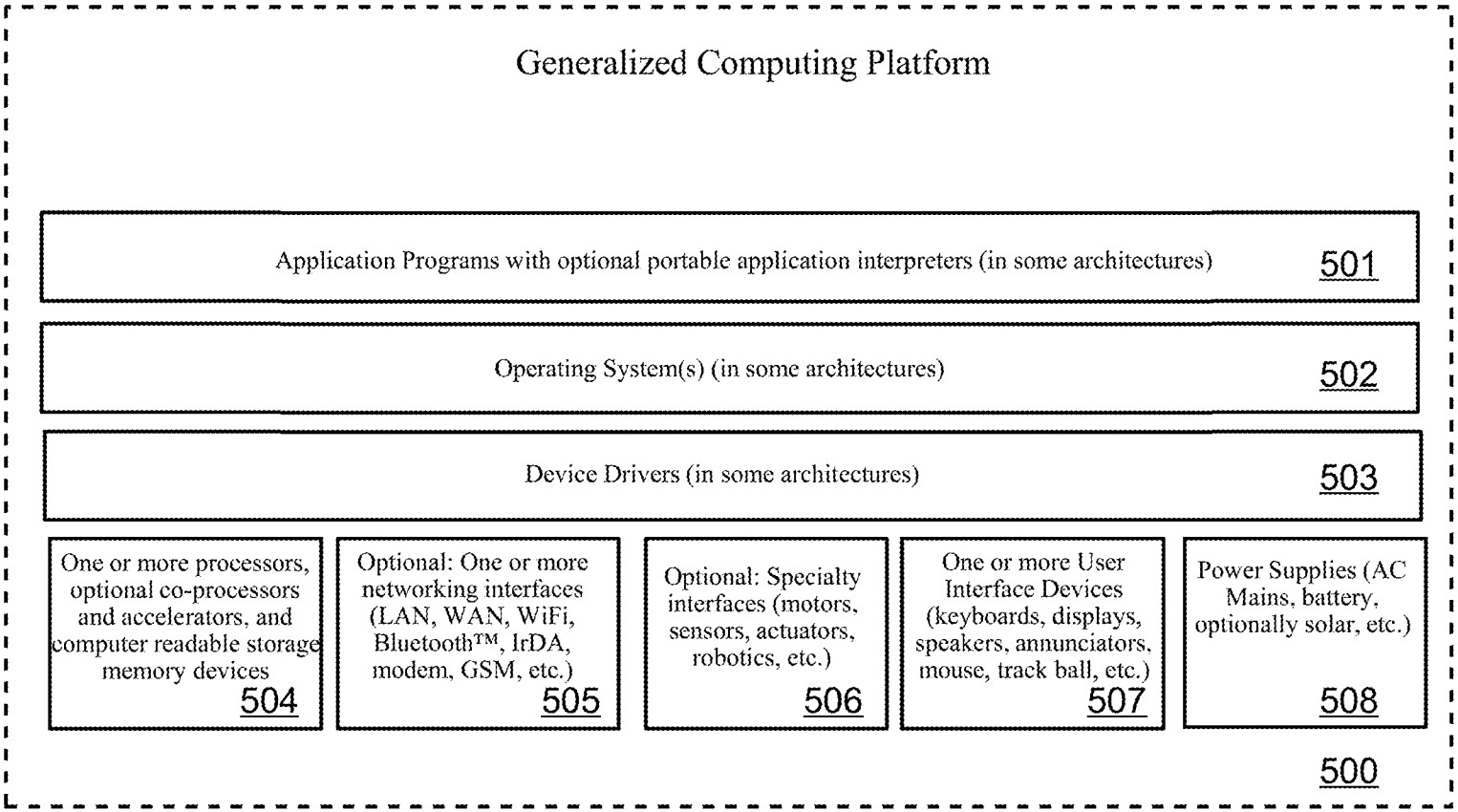
FIG. 5 sets forth a generalized architecture of computing platforms suitable for at least one embodiment of the related invention.

The present and related inventions may be realized for many different processors used in many different computing platforms. FIG. 5 illustrates a generalized computing platform (500), such as common and well-known computing platforms such as "Personal Computers", web servers such as an IBM iSeries™ server, and portable devices such as personal digital assistants and smart phones, running a popular operating systems (502) such as Microsoft™ Windows™ or IBM™ AIX™, Palm OS™, Microsoft Windows Mobile™, UNIX, LINUX, Google Android™, Apple iPhone iOS™, and others, may be employed to execute one or more application programs to accomplish the computerized methods described herein. Whereas these computing platforms and operating systems are well known an openly described in any number of textbooks, websites, and public "open" specifications and recommendations, diagrams and further details of these computing systems in general (without the customized logical processes of the present invention) are readily available to those ordinarily skilled in the art.

Many such computing platforms, but not all, allow for the addition of or installation of application programs (501) which provide specific logical functionality and which allow the computing platform to be specialized in certain manners to perform certain jobs, thus rendering the computing platform into a specialized machine. In some "closed" architectures, this functionality is provided by the manufacturer and may not be modifiable by the end-user.

The "hardware" portion of a computing platform typically includes one or more processors (504) accompanied by, sometimes, specialized co-processors or accelerators, such as graphics accelerators, and by suitable computer readable memory devices (RAM, ROM, disk drives, removable memory cards, etc.). Depending on the computing platform, one or more network interfaces (505) may be provided, as well as specialty interfaces for specific applications. If the computing platform is intended to interact with human users, it is provided with one or more user interface devices (507), such as display(s), keyboards, pointing devices, speakers, etc. And, each computing platform requires one or more power supplies (battery, AC mains, solar, etc.).

Conclusion. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

It should also be recognized by those skilled in the art that certain embodiments utilizing a microprocessor executing a logical process may also be realized through customized electronic circuitry performing the same logical process(es).

It will be readily recognized by those skilled in the art that the foregoing example embodiments do not define the extent or scope of the present invention, but instead are provided as illustrations of how to make and use at least one embodiment of the invention. The following claims define the extent and scope of at least one invention disclosed herein.

What is claimed is:

1. A method for preventing overbidding by a user in an electronic auction comprising:

receiving by a computer from a user's console a command to monitor an first item with a link to a listing for the first item in an online auction by an online auction server;

extracting by a computer from an electronic auction server one or more item descriptive parameters of the first item from an online listing of the electronic auction server;

throughout a window of auction for the first item:

using by a computer the extracted parameter to query one or more electronic sales servers for alternative items matching the extracted parameters, wherein the sales servers comprise servers other than the electronic auction server;

monitoring in real-time by a computer at least one current price for at least one matching alternative item from the one or more sales servers;

monitoring in real-time a pace of bidding in the electronic auction on the first item; and responsive detecting the pace being increased by a predetermined threshold and a current bid price in the electronic auction meeting or exceeding the monitored current price for at least one matching alternative item:

providing to a first user on a computer interface a bidding frenzy alert; and disabling all automatic bidding on behalf of the first user by issuing a restraint signal to an automatic bidding agent of the electronic auction server, thereby preventing automatic overbidding on the first item on behalf of the user and reducing computational resource demand of the electronic auction server to handle the restrained bids.

2. The method as set forth in claim 1 further comprising providing by a computer a user-selectable navigation control to automatically navigate the user's console to the sales source and a listing for the similar item.

3. The method as set forth in claim 2 wherein the navigation control comprises a hyperlink.

4. The method as set forth in claim 1 further comprising providing a vigilance panel on the user console.

5. The method as set forth in claim 1 further comprising:

summing by a computer a convenience offset value with the at least one price for the alternative item; and responsive to a bid value exceeding the sum prompting the user regarding the alternative item from the sales server.

6. The method as set forth in claim 1 further comprising:

performing by a computer an analysis of historical sales values of at least one alternative item; and prompting of the user regarding the historical sales values, thereby informing the user of likely bidding success or failure according to historical sales data for similar items.

7. A computer program product for preventing overbidding by a user in an electronic auction comprising:

one or more tangible, computer readable memory devices excluding a propagating signal per se; and one or more program instructions embodied by the one or more tangible, computer readable memory devices, configured to cause a computer processor to perform the operations of:

receiving by a computer from a user's console a command to monitor an first item with a link to a listing for the first item in an online auction by an online auction server;

extracting by a computer from an electronic auction server one or more item descriptive parameters of the first item from an online listing of the electronic auction server;

throughout a window of auction for the first item:

using by a computer the extracted parameter to query one or more electronic sales servers for alternative items matching the extracted parameters, wherein the sales servers comprise servers other than the electronic auction server;

monitoring in real-time by a computer at least one current price for at least one matching alternative item from the one or more sales servers;

monitoring in real-time a pace of bidding in the electronic auction on the first item; and responsive detecting the pace being increased by a predetermined threshold and a current bid price in the electronic auction meeting or exceeding the monitored current price for at least one matching alternative item:

providing to a first user on a computer interface a bidding frenzy alert; and disabling all automatic bidding on behalf of the first user by issuing a restraint signal to an automatic bidding agent of the electronic auction server, thereby preventing automatic overbidding on the first item on behalf of the user and reducing computational resource demand of the electronic auction server to handle the restrained bids.

8. The computer program product as set forth in claim 7 wherein the program instructions further comprise program instructions to provide a user-selectable navigation control to automatically navigate the user's console to the sales source and a listing for the similar item.

9. The computer program product as set forth in claim 8 wherein the navigation control comprises a hyperlink.

10. The computer program product as set forth in claim 7 wherein the program instructions further comprise program instructions for providing a vigilance panel on the user display in proximity to a display associated with the auction.

11. The computer program product as set forth in claim 7 wherein the program instructions further comprise program instructions for:

summing a convenience offset value with the at least one price for the alternative item; and responsive to a bid value exceeding the sum prompting the user regarding the alternative item from the sales server.

12. The computer program product as set forth in claim 7 wherein the program instructions further comprise program instructions to:

perform an analysis of historical sales values of at least one of the alternative similar items; and prompt the user regarding the historical sales values, thereby informing the user of likely bidding success or failure according to historical sales data for similar items.

13. A system for preventing overbidding by a user in an electronic auction comprising:

a computer processor;

one or more tangible, computer readable memory devices excluding a propagating signal per se; and one or more program instructions embodied by the one or more tangible, computer readable memory devices, configured to cause the computer processor to perform the operations of:

receiving by a computer from a user's console a command to monitor an first item with a link to a listing for the first item in an online auction by an online auction server;

extracting by a computer from an electronic auction server one or more item descriptive parameters of the first item from an online listing of the electronic auction server;

throughout a window of auction for the first item:

using by a computer the extracted parameter to query one or more electronic sales servers for alternative items matching the extracted parameters, wherein the sales servers comprise servers other than the electronic auction server;

monitoring in real-time by a computer at least one current price for at least one matching alternative item from the one or more sales servers;

monitoring in real-time a pace of bidding in the electronic auction on the first item; and responsive detecting the pace being increased by a predetermined threshold and a current bid price in the electronic auction meeting or exceeding the monitored current price for at least one matching alternative item:

providing to a first user on a computer interface a bidding frenzy alert; and disabling all automatic bidding on behalf of the first user by issuing a restraint signal to an automatic bidding agent of the electronic auction server, thereby preventing automatic overbidding on the first item on behalf of the user and reducing computational resource demand of the electronic auction server to handle the restrained bids.

14. The system as set forth in claim 13 wherein the program instructions further comprise program instructions to automatically navigate the user's console to the sales source and a listing for the similar item.

15. The system as set forth in claim 14 wherein the navigation control comprises a hyperlink.

16. The system as set forth in claim 13 wherein the program instructions further comprise program instructions for providing a vigilance panel on the user display.

17. The system as set forth in claim 13 wherein the program instructions further comprise program instructions for:

summing a convenience offset value with the at least one price for the alternative item; and responsive to a bid value exceeding the sum prompting of a user regarding the alternative item from the sales server.

18. The system as set forth in claim 13 wherein the program instructions further comprise program instructions for:

performing an analysis of historical sales values of at least one of the alternative items; and prompting of the user regarding the historical sales values, thereby informing the user of likely bidding success or failure according to historical sales data for similar items.

* * * * *